US006298580B1

(12) United States Patent
Tadayon

(10) Patent No.: US 6,298,580 B1
(45) Date of Patent: Oct. 9, 2001

(54) PEDICURE SANDALS

(76) Inventor: Sally Tadayon, 24 Burnaby Street, London, SW10 0PJ (GB)

( * ) Notice: Subject to any disclaimer, the term of this patent is extended or adjusted under 35 U.S.C. 154(b) by 0 days.

(21) Appl. No.: 09/515,486

(22) Filed: Feb. 29, 2000

(51) Int. Cl.[7] ..... A43B 3/12
(52) U.S. Cl. ..... 36/11.4; 36/94; D2/916
(58) Field of Search ..... 36/11.5, 7.5, 94, 36/8.1, 9 R, 88; 602/30; D2/916, 917, 948, 896

(56) References Cited

U.S. PATENT DOCUMENTS

| | | | | |
|---|---|---|---|---|
| D. 162,870 | * | 4/1951 | Pearce | D2/917 |
| D. 163,430 | * | 5/1951 | Westmore | D2/948 |
| D. 260,047 | * | 8/1981 | Heinz | D2/916 |
| D. 271,156 | * | 11/1983 | Williamson | D2/916 |
| 1,349,095 | | 8/1920 | Parisi . | |
| 1,867,679 | | 7/1932 | Riehle et al. . | |
| 2,506,308 | | 5/1950 | Maynier . | |
| 2,740,207 | | 4/1956 | Starensier . | |
| 2,751,693 | | 6/1956 | Baker . | |
| 2,808,662 | | 10/1957 | Webb . | |
| 4,017,987 | | 4/1977 | Perez, Jr. et al. . | |
| 4,030,212 | * | 6/1977 | Ito | 36/11.5 |
| 4,207,880 | | 6/1980 | Zinkovich . | |
| 5,615,496 | * | 4/1997 | Sharpstein | 36/11.5 |
| 5,737,853 | * | 4/1998 | Smejkal | 36/11.5 |
| 5,870,837 | | 2/1999 | Poulos . | |
| 5,946,823 | | 9/1999 | Yates . | |

* cited by examiner

*Primary Examiner*—Paul T. Sewell
*Assistant Examiner*—Jila Mohandesi
(74) *Attorney, Agent, or Firm*—Everett G. Diederiks, Jr.

(57) ABSTRACT

A sandal is formed as a one-piece construction and includes a sole incorporating toe dividing structure that can be shifted to a position wherein toes of a user can be arranged between dividers to enhance the ability of the user to obtain a pedicure. This toe dividing structure is preferably formed by making perforations or cuts in the sole such that the toe dividing structure can be popped out of the sole. The cuts are made to form a number of discrete dividers, with each divider being adapted to be placed between adjacent toes of the user. A strap is also preferably cut out of the sole to aid in securing the sandal to a user's foot. The sole is made of a cushion material to make the sandal comfortable to wear.

19 Claims, 2 Drawing Sheets

PEDICURE SANDALS

FIELD OF THE INVENTION

The present invention relates to footwear in general and in particular to sandals which may be used, for example, as a pedicure aid.

BACKGROUND OF THE INVENTION

Whilst giving a pedicure, a beautician may wish to apply nail polish to the toenails. To assist in this, toe dividers are known which may be inserted between the toes to separate the toes so as to facilitate application of the nail polish and also prevent toes accidentally coming into contact with freshly applied polish.

It has been proposed to incorporate such toe dividers in a sandal so that a person receiving a pedicure may walk around in comfort after the pedicure, but without damaging the nail polish. Examples of such proposals are shown in U.S. Pat. Nos. 5,870,837, 5,946,823 and 4,017,987.

Whilst such devices may be effective in preventing damage to a pedicure, they are all somewhat complicated in construction. Accordingly what is needed is a pedicure sandal which is simple to manufacture and easy to use.

SUMMARY OF THE INVENTION

It is an object of the invention to provide a pedicure sandal which is easy to manufacture and which is easy to use and which can still provide effective separation of the toes and allow a user to walk around in comfort after a pedicure.

According to the invention there is provided a pedicure sandal comprising: a sole and toe dividing means defined within said sole wherein said toe dividing means are capable of being moved out of the sole for engagement between the toes of a user, whilst still being attached to the sole.

In accordance with the invention toe dividing means are provided in the sole and can be moved out of the sole for engagement between the toes of a user whilst still being attached to the sole. This affords a very simple yet effective sandal construction.

Preferably the sandal is a one-piece construction with the toe dividing means and the sole being formed of the same piece of material. This considerably simplifies construction.

Preferably the sole is generally planar and it is most preferably of a flexible material so as to permit easy movement by a user. Furthermore, the sole is preferably of a cushion material such as foam, sponge rubber or the like so as to cushion the foot and make the sandal comfortable to wear.

Preferably the toe dividing means is defined by one or more lines of weakness provided in the sole, for example perforations or cuts provided in the sole. Preferably the perforations, cuts or the like extend completely through the sole, so that the toe dividing means extends for the full thickness of the sole. This will allow the toe dividing means easily to be pushed out of the sole for engagement with the toes of a user. The cuts defining the toe dividing means may be continuous or intermittent.

As stated above, the toe dividing means is attached to the sole when deployed in use. In the preferred embodiment, the toe dividing means is hingedly connected to the sole by suitable hinge means, although a hinged connection is not essential.

Most preferably, such hinge means are formed by a section of the sole material itself, at the base of the toe dividing means. Preferably, the thickness of the material of the sole is locally reduced to form the hinge, for example by a forming a cut which extends only partially through the thickness of the sole, so as to facilitate hinging of the toe dividing means. Alternatively the hinge may be formed by creasing the sole material in the appropriate position, for example by crimping under heat and pressure.

The toe dividing means could comprise a number of discrete dividers, each individual divider being for placement between adjacent toes. Preferably, however, the toe dividing means comprises a unitary body comprising a plurality of formations for inserting between the toes. This is advantageous in that it allows the toe dividing means to be moved out of the sole in a single action, thereby facilitating use of the sandal.

In addition to the toe dividing means, the sandal may also be provided with a strap for helping secure the sandal on a user's foot.

Preferably such strap means are also defined in the sole so that they can be moved out of the sole for engagement with the user's foot. Again the strap means may be defined by lines of weakness such as perforations or cut lines in the sole.

Preferably the strap is defined in a peripheral region around the rear of the sandal. Preferably the strap is positioned such that it may be positioned around the mid-region of the foot, i.e. a user may place their foot through the strap after it has been released from the sole. However, other arrangements are possible. For example the strap means may be configured and arranged such that they may engage over the heel of the foot. In such a case, the hinge line of the strap may be defined more towards the rear of the sandal.

The strap may be configured so as to be variable in length. For example, the strap may be secured to the sole at different points along its length by bridges of material which can be broken as necessary to release an appropriate length of strap material.

Other objects and advantages of this invention will become apparent from the following description taken in conjunction with the accompanying drawings which show, by way of illustration and example only, a preferred embodiment of this invention.

DETAILED DESCRIPTION OF THE PREFERRED EMBODIMENT

Figures 1, 2, 2A:
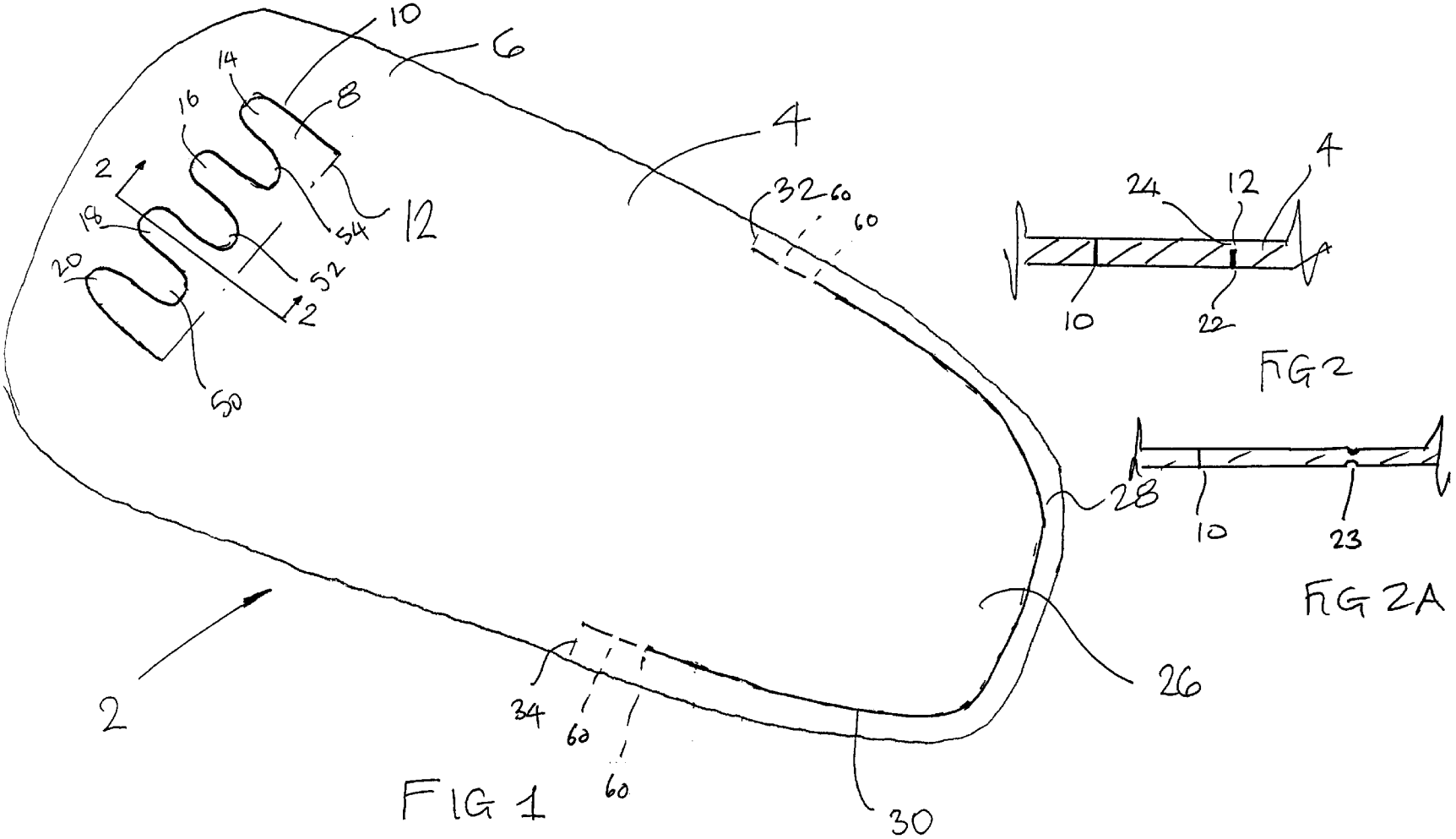
FIG. 1 is a top view of a sandal in accordance with the invention.
FIG. 2 is a sectional view along the line 2—2 of FIG. 1.
FIG. 2A is a view corresponding to FIG. 2 showing an alternative hinge construction.

Referring now to the Figures, a pedicure sandal 2 comprises a sole 4 made from a flexible cushion material such as foam or sponge rubber. The sole 4 is generally planar and is generally foot-shaped to receive a user's foot. The sole material is typically between 5 and 10 mm thick.

The front region 6 of the sole is provided with a toe dividing member 8. The toe dividing member 8 is defined in the sole by a line of weakness such as a cut 10 which preferably extends through the entire thickness of the sole. The toe dividing member 8 is, further, attached to the sole along a hinge line 12.

The lines of weakness or cut lines 10 define four projections 14, 16, 18 and 20 which extend away from the hinge line 12 and which in use will be positioned between a user's toes. The cut line 10 may be continuous, as shown, or intermittent so that bridges are formed between the projections 14, 16, 18 and 20 and the surrounding sole material. These bridges may assist in keeping the projections in their flat position until needed, and they should be sufficiently weak so that they can be easily broken when the toe dividing member 8 is pushed into its operative position.

The hinge line 12 facilitates the movement of the toe dividing member 8 into an operative position. As can be seen from FIG. 2, the hinge line 12 is most conveniently formed by providing a cut 22 on the undersurface of the sole, the cut not extending completely through the thickness of the sole 4 so as to leave a hinge of sole material 24 of reduced thickness. This will allow the toe dividing member more easily to pivot into position and will also reduce the tendency of the toe dividing member to return into the plane of the sole due to the resilience of the sole material.

In an alternative embodiment, the hinge may be formed by crimping the sole material preferably at elevated temperature so as locally to reduce the thickness of the sole material. Such an arrangement is shown schematically in FIG. 2A. The crimp may be on just one side of the sole or on both, as shown.

The rear portion 26 of the sole 4 comprises a strap 28. The strap 28 is defined by a generally U-shaped line of weakness of cut line 30 which extends generally parallel to the outline of the sole 4. The ends of the strap 28 are hinged to the sole 4 by hinges 32, 34. The hinges 32, 34 may be defined by a part depth cut formed on the undersurface of the sole 4. These hinges 32,34 thus operate in the same manner as the hinge 12 of the toe dividing member 8. The strap may be connected to the sole by bridges of material 60 shown in FIG. 1 so that the strap can be adjusted in length by breaking only the requisite number of bridges 60 when releasing the strap. The hinges 32, 34 will then be formed at the first intact bridge 60. This will allow the strap to be adapted to the user's foot size.

Figure 3:
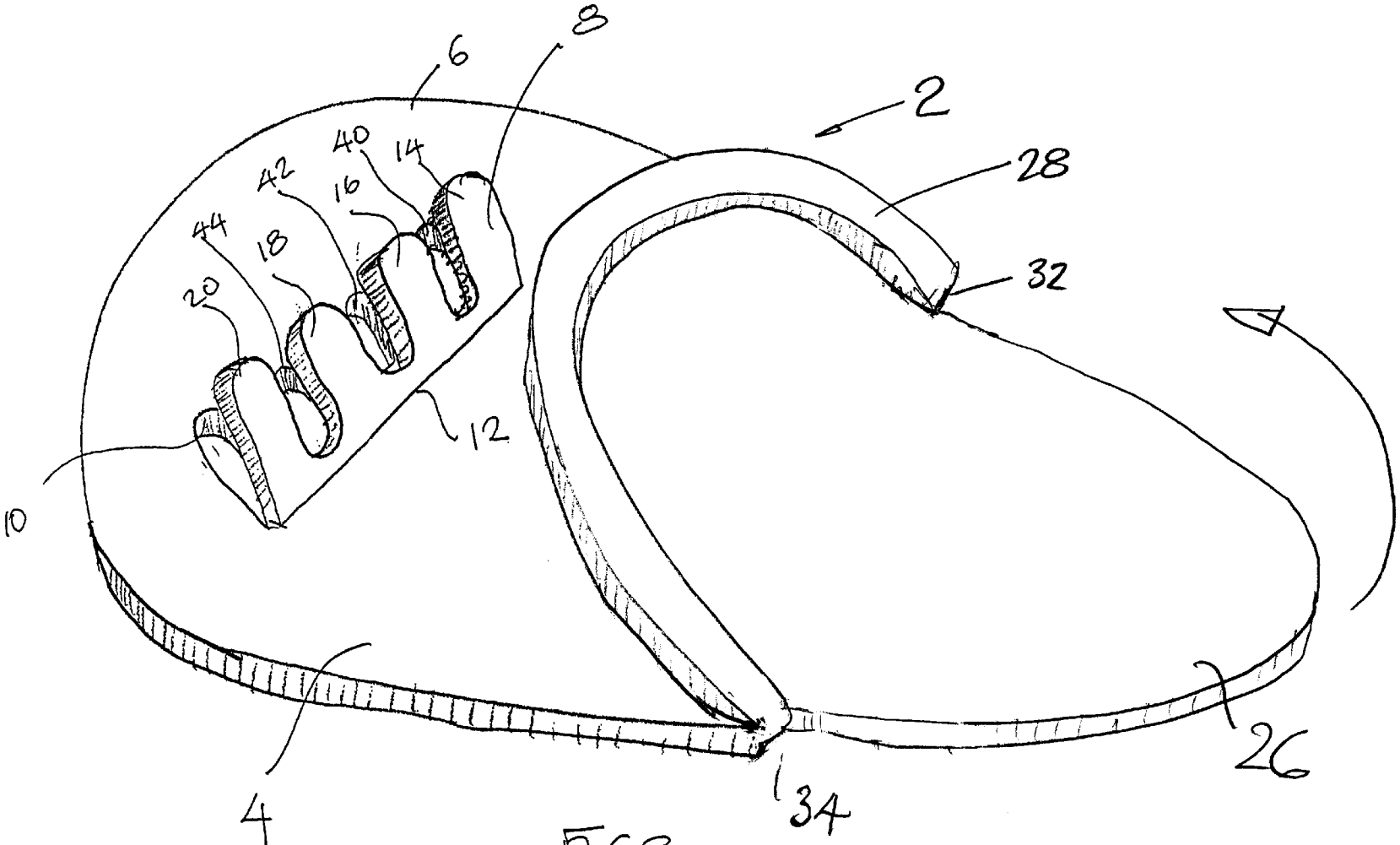
FIG. 3 is a perspective view of the sandal of FIG. 1 in an operative configuration.

Use of the sandal of the invention will now be described. The sandal 2 will initially be in a completely flat state, and when it is desired to position the sandal 2 on the foot, a user merely needs to push the toe dividing member 8 up out of the sole by pressing on the underside of the projections 14, 16, 18 and 20 to bring the toe dividing member 8 into a generally vertical orientation, as shown in FIG. 3. At the same time, the strap 28 is released and rotated in the direction of arrow 36 to a position generally as shown in FIG. 3. A user may then insert their foot through the strap 28 and insert their toes into the spaces 40, 42 and 44 defined between the projections. The projections 14, 16, 18 and 20 will then separate the user's toes such that the likelihood of damage to nail polish applied is minimised. As the projections are of the same material as the sole, they are cushioned and flexible, allowing the toes to be inserted easily and well supported in comfort.

The user's toes will be supported by the material of the sole 4 in the front portion 6, namely the sole around the sides of the toe dividing member 8 and also the projecting parts 50, 52 and 54 in the sole which are left when the toe dividing member 8 is erected.

Although the toe dividing member will to some extent retain the sandal on a user's foot, this is assisted by the strap 28 which engages over the mid region of the user's foot.

A user may then walk around with comfort and at the same time protect the pedicure.

It will be clear that the above described embodiment has a number of advantages. The sandal is one-piece, thereby avoiding the need for expensive assembly. For example, the sandal may be very easily manufactured by cutting the appropriate shape from a sheet of material. The sandals may be stored in a very space efficient manner due to their flatness, making them extremely easy to store. For example, a pair of sandals might only have a thickness of 10–20 mm.

Furthermore, because the sandal is manufactured in one piece it is relatively inexpensive to manufacture and if desired, may be discarded after use.

It will be appreciated that the above-described embodiment is exemplary only and that various modifications may be made to that embodiment without departing from the spirit and scope of the invention. For example, the shape of the sole may be different to that shown in the embodiment and it may be patterned or otherwise adorned. It may formed from a different material to foam rubber. Also, the particular shape of the toe dividing member may be different and rather than being one integral divider the projections may be provided as individually hinged members.

Furthermore, the strap may be provided in another location and shaped so that it does not necessarily need to engage with the mid region of the foot but could, for example, be placed over the heel of the foot.

Also whilst the strap and toe dividing means have been shown as having a formed hinge, the resilience of the sole material itself may obviate the need for such, and the material itself may act as a hinge.

Also, whilst the sandal has been described for use as a pedicure aid, it may have broader application.

What is claimed is:

1. A pedicure sandal comprising:

a generally planar sole; and toe dividing means defined within said sole, said toe dividing means being formed integrally with said sole while being movable from a first position in which the toe dividing means is coplanar with the sole and a second position in which the toe dividing means is arranged out of a plane of the sole for engagement with toes of a user, while still being attached to the sole, said toe dividing means having a proximal end attached to said sole in said second position and a distal end, wherein said toe dividing means constitutes a unitary body including a plurality of formations for inserting between toes, and wherein the distal end of said toe dividing means is spaced from a front edge of the sole.

2. The pedicure sandal as claimed in claim 1 wherein the sole is made from a flexible material.

3. The pedicure sandal as claimed in claim 1 wherein the sole is formed from a cushioning material.

4. The pedicure sandal as claimed in claim 1 wherein said sandal is of a one-piece construction and the said toe dividing means is defined by one or more lines of weakness provided in the sole.

5. The pedicure sandal as claimed in claim 4 wherein said lines of weakness comprise cuts formed in the sole.

6. The pedicure sandal as claimed in claim 5 wherein said cuts extend completely through the sole.

7. The pedicure sandal as claimed in claim 1 wherein said toe dividing means is hingedly connected to the sole by hinge means.

8. The pedicure sandal as claimed in claim 7 wherein said hinge means is formed by a section of the sole material at the proximal end of the toe dividing means.

9. The pedicure sandal as claimed in claim 8 wherein the sole has a thickness which is locally reduced to form the hinge means.

10. The pedicure sandal as claimed in claim 1 further comprising: a strap for use in securing the sandal on a foot of a user.

11. The pedicure sandal as claimed in claim 10 wherein said strap is defined from the sole by lines of weakness.

12. The pedicure sandal as claimed in claim 11 wherein said strap is defined in a peripheral region around a rear portion of the sandal.

13. A one piece pedicure sandal comprising:

a planar sole member having a front edge and a rear edge; and toe dividing means, defined within a plane of said sole, having a distal end and a proximal end, with the proximal end being hingedly connected to said sole member, said toe dividing means defining a unitary body having a plurality of formations for insertion between toes of a user at the distal end, wherein the distal end of said toe dividing means is spaced from the front edge of the sole member.

14. The one piece pedicure sandal as claimed in claim 13 wherein said toe dividing means is defined by cut lines provided in the sole member.

15. The one piece pedicure sandal as claimed in claim 14 wherein said sole member further comprises strap means defined by cut lines provided in the sole member.

16. The one piece pedicure sandal as claimed in claim 15 wherein said strap means is defined around a rear edge of the sole member.

17. A one piece pedicure sandal comprising:

a planar, flexible sole member having a front edge and a rear edge; and a toe engaging member integrally formed with said sole member, said toe engaging member constituting a unitary body including a proximal end, a distal end and a plurality of formations defined between the proximal and distal ends for insertion between adjacent toes of a user, the toe engaging member being attached to the sole member by a hinge formed across the proximal end such that the toe engaging member is pivotable out of a plane of the sole member into an operative position for engagement with toes of a user, the distal end of said toe dividing means being spaced from the front edge of the sole.

18. A one piece pedicure sandal comprising:

a planar sole made from a flexible, cushioning material, said sole having a thickness and a front edge; and toe dividing means defined within a plane of said sole, said toe dividing means including a proximal end, a distal end and a plurality of formations for engagement between toes of a user, said toe dividing means being attached to the sole at the proximal end and being defined by one or more cut extending completely through the thickness of the sole allowing the toe dividing means to be moved out of a plane of the sole for engagement with toes of a user, and wherein the distal end of said toe dividing means is spaced from the front edge of the sole.

19. The one piece pedicure sandal as claimed in claim 18 further comprising: strap means formed in the sole for assisting in retaining the sandal on a foot of a user.

* * * * *